US006790244B2

(12) United States Patent
Saunders et al.

(10) Patent No.: US 6,790,244 B2
(45) Date of Patent: Sep. 14, 2004

(54) PACKAGED STACKABLE CHARCOAL BRIQUET

(75) Inventors: Craig M. Saunders, Rocky River, OH (US); Lindsey Tufts, Jr., Euclid, OH (US); David J. Boll, Avon, OH (US)

(73) Assignee: Nottingham-Spirk Design Associates, Inc., Cleveland, OH (US)

( * ) Notice: Subject to any disclaimer, the term of this patent is extended or adjusted under 35 U.S.C. 154(b) by 0 days.

(21) Appl. No.: 10/172,549

(22) Filed: Aug. 7, 2002

(65) Prior Publication Data

US 2004/0025419 A1 Feb. 12, 2004

(51) Int. Cl.[7] ..... C10L 5/00

(52) U.S. Cl. ..... 44/550; 44/530; 44/532; 44/541; D13/100

(58) Field of Search ..... 44/530, 532, 541, 44/550, 522; D13/100

(56) References Cited

U.S. PATENT DOCUMENTS

| | | | | | |
|---|---|---|---|---|---|
| 236,889 | A | * | 1/1881 | Hammer et al. | 44/506 |
| D34,677 | S | | 6/1901 | Rockwell | |
| 978,182 | A | * | 12/1910 | McCan | 44/530 |
| 1,194,613 | A | * | 8/1916 | Fredikson | 44/530 |
| 1,959,473 | A | | 5/1934 | Heron | |
| 3,010,809 | A | | 11/1961 | Peck | |
| 3,031,277 | A | | 4/1962 | Strauss | |
| 3,370,582 | A | | 2/1968 | Rauh | |
| 3,374,071 | A | | 3/1968 | Corriher, Jr. et al. | |
| 3,650,711 | A | | 3/1972 | Urick et al. | |
| 3,866,748 | A | | 2/1975 | Manning, Jr. | |
| 3,877,886 | A | | 4/1975 | Daizell | |
| 3,902,705 | A | | 9/1975 | Easwaran | |
| 3,927,993 | A | | 12/1975 | Griffin | |
| 3,950,143 | A | | 4/1976 | Pyle | |
| 4,101,292 | A | | 7/1978 | Hogan, II | |
| 4,175,925 | A | | 11/1979 | Paek et al. | |
| 4,243,394 | A | | 1/1981 | Kincaid | |
| D272,848 | S | * | 2/1984 | Koziol | D13/100 |
| 4,442,681 | A | | 4/1984 | Fischer | |
| 4,460,377 | A | | 7/1984 | Kalil | |
| D275,224 | S | * | 8/1984 | Darche | D13/100 |
| 4,496,366 | A | | 1/1985 | Peters | |
| D298,027 | S | | 10/1988 | Stephenson | |
| 4,775,391 | A | | 10/1988 | Antosko | |
| 4,793,320 | A | | 12/1988 | Bakic | |
| 4,810,256 | A | | 3/1989 | Fay, III et al. | |
| 4,822,380 | A | | 4/1989 | Young | |
| 4,832,703 | A | | 5/1989 | Campana et al. | |
| 4,834,774 | A | | 5/1989 | Fay, III et al. | |
| D304,574 | S | | 11/1989 | Fay, III | |
| D305,752 | S | | 1/1990 | Chow | |
| 4,899,721 | A | | 2/1990 | Tsay | |
| 5,038,573 | A | | 8/1991 | McAllister | |
| D330,362 | S | * | 10/1992 | Harris | D13/100 |
| 5,186,721 | A | | 2/1993 | Campana | |
| 5,252,107 | A | | 10/1993 | Wilkins, Jr. | |
| 5,290,326 | A | | 3/1994 | Campana | |
| 5,762,656 | A | | 6/1998 | Burke et al. | |
| 5,830,245 | A | | 11/1998 | Raddon | |
| D406,635 | S | | 3/1999 | Russell et al. | |
| 5,893,946 | A | | 4/1999 | Landis | |
| 6,080,214 | A | | 6/2000 | Mungia | |
| 6,136,053 | A | | 10/2000 | Sullivan | |
| 6,224,643 | B1 | | 5/2001 | Mungia | |
| 6,328,028 | B1 | | 12/2001 | Cayse et al. | |
| 6,345,802 | B2 | | 2/2002 | Moore | |
| 6,357,653 | B1 | | 3/2002 | Murcia | |

* cited by examiner

*Primary Examiner*—Cephia D. Toomer
(74) *Attorney, Agent, or Firm*—Fay, Sahrpe, Fagan, Minnich & McKee

(57) ABSTRACT

An improved stackable charcoal briquet has a convex bottom and a concave top and is packaged in a stacked compact boxed package. A charcoal briquet having improved burning characteristics and also improved shipping and retailing characteristics is thereby provided.

78 Claims, 5 Drawing Sheets

PACKAGED STACKABLE CHARCOAL BRIQUET

FIELD OF THE INVENTION

This invention relates to the field of charcoal briquets for use in home barbequing and the like, and particularly to an improved shape for the briquet, package for the briquet, and method of burning the briquets in home barbequing.

BACKGROUND OF THE INVENTION

Charcoal briquets are widely used by consumers in cooking and barbequing in outdoor grills, grates, and other locations. Conventional charcoal briquets are pillow-shaped and sold in multi-pound paper bag containers. The briquets are contained somewhat loosely in the paper bag container. Because of the random loose pack, abrasion between adjacent briquets in the bag is common, creating dust which often leaks out of the bag. Thus, a dusty, messy environment is created in shipping and retailing these packages. Additionally, the bags themselves are not a convenient shape for stacking or palletizing. This makes the products difficult to handle in shipping and also in retailing. The bags often weigh 5, 8, 10, 15, and 20 pounds. Because of their shape and charcoal dusty condition, they are inconvenient for consumers to handle when shopping, transporting, or storing.

Charcoal briquets are mainly used to prepare barbequed or grilled food items. One mechanism of use is to pile charcoal briquets in the center of a grill, apply an ignition fluid to the piled briquets, and ignite the ignition fluid. An ignition fluid is required, as conventional charcoal briquets are slow to ignite. The burn time of the ignition fluid ignites the surface of the charcoal briquets in the pile. After a sufficient burn time, the charcoal briquets in the pile are ignited. This becomes apparent to the user when a gray ash layer forms on the surface of the briquets. When the ash layer is observed, the briquets are spread out in the grill bottom and are ready for use in cooking.

Charcoal briquets are conventionally fabricated from base fuels such as charred wood, coal, charred agricultural waste, and similar products. Conventional briquets also use a binder which can be a vegetable starch or other conventional binder material. Some conventional charcoal briquets also include ignition aids which are materials which ignite more quickly than the base fuel and help in ignition of the charcoal briquet. This invention is not concerned with the composition of the charcoal briquet, but rather the shape and packaging of the charcoal briquet that is useable with any charcoal briquet materials and composition. Conventional materials and compositions are well known in the art and described in, for instance, U.S. Pat. No. 5,762,656 to Burke, et al.

While charcoal briquets are widely used for cooking on grills and in barbeque pits, numerous problems exist with this fuel source. Conventional charcoal briquets are often hard to ignite and require the use of an auxiliary ignition fluid. Charcoal briquets are conventionally marketed in large bags which are difficult to handle in shipping, retailing and by the consumer. Such bags are not easily stacked, and cannot be conveniently displayed in an upright position in retail stores. Conventional charcoal briquets are normally packaged in large bags, from which a consumer must pour out the desired amount, measuring informally and often using less or more than is appropriate for the meal to be cooked. The remaining charcoal briquets in the bag must be stored in an open bag, which is messy, and often leaks carbon dust. The burn characteristics of conventional charcoal are also less than ideal with too much time being spent in the ignition phase prior to the cooking phase in which food is actually cooked over the ignited briquets.

SUMMARY OF THE INVENTION

In accordance with the present invention, an improved charcoal briquet and package for multiple briquets is provided which overcomes the above referred to problems and others and is more conveniently marketed to consumers and used by consumers in grilling and barbequing.

In accordance with the present invention, a charcoal briquet is provided having a generally convex top surface, a generally concave bottom surface adapted to engage and rest upon a top surface of an adjacent briquet, and a generally rectangular periphery.

Still further in accordance with the invention, the briquet is provided with a central hole through from the bottom surface to the top surface.

Still further in accordance with the invention, a commercial package of briquets is provided in which a measured quantity of briquets is stacked one upon the other and contained in a cardboard box relatively tightly, confining the charcoal briquets in the stack and sealing the top and bottom of the stack.

Still further in accordance with the invention, the cardboard box containing the briquets is preferably coated or impregnated with wax or a similar substance, whereby the dust associated with the briquets is contained in the package, and the package acts as an integral ignition aid.

Still further in accordance with the invention, a one-stack package is sized to hold an appropriate number of charcoal briquets for a single barbeque or grilling event.

Still further in accordance with the invention, a commercial multi-pack product is comprised of several single stack packages fixed to or packed with one another into a multi-pack, multi-pound unit bearing a universal product code appropriate for the number of units being sold.

Still further in accordance with the invention, the charcoal briquets comprise four interconnected side walls of generally identical cross section forming a rectangle with each side wall having a volume surrounded by a generally flat, horizontal bottom surface; an upwardly and inwardly extending lower surface; and, an upwardly and inwardly extending upper surface generally parallel to the lower surface. The briquets also have a inner surface extending from the lower surface to the upper surface and surrounding a central hole. The bottom surface of the lowest briquet in the stack is adapted to rest upon a horizontal surface. The lower surface of briquets other than the bottom briquet is adapted to rest upon the upper surface of the next lower briquet around their entire periphery, thereby forming a generally stable and compact arrangement.

Still further in accordance with the invention, the lower surface of the briquet is gently curved in its convexity, but generally slopes upwardly and inwardly at an angle of about 30° to the horizontal.

Yet further in accordance with the invention, the upper surface of the briquet is somewhat curved in its convexity, but generally extends upwardly at an angle of about 30° or slightly greater than 30° to the horizontal.

Still further in accordance with the invention, the briquets are generally square in shape, having gently rounded outer peripheral edges interconnected by sharply rounded corners.

Still further in accordance with the present invention, the briquets are packaged in a tightly fitting cardboard box surrounding the periphery of the briquets, with the cardboard preferably coated or impregnated with wax or a similar substance.

Still further in accordance with the present invention, the briquets can be used to create grilling combustion by merely placing the single-stack container into a grill, igniting the outer package, allowing the ignition of the outer package to ignite the periphery of the briquets, and thereupon spreading the briquets into a charcoal bed.

It is a principal object of the present invention to provide a charcoal briquet product having increased surface area for improved burn characteristics and an improved compact package for this product.

It is still a further object of the present invention to provide an improved package for a charcoal briquet in which the charcoal briquets are tightly contained whereby abrasion between adjacent briquets is minimized, thereby reducing the creation of waste dust.

It is still a further object of the present invention to provide an improved package for charcoal briquets in which charcoal briquets are stacked in a compact form, minimizing the space occupied by the package during shipping, handling, retail display, transporting, and storage.

It is still another object of the present invention to provide a packaged charcoal briquet product in which generally rectangular charcoal briquets are stacked creating a rectangular solid box which is easily stacked, displayed, palletized, and merchandised.

It is still another object of the present invention to provide a packaged charcoal briquet product in a solid rectangular box which is less likely to leak charcoal dust than conventional bags.

It is still another object of the present invention to provide a rectangular charcoal briquet product which is easily handled by the consumer and used by the consumer in initiating a barbeque.

It is still another object of the present invention to provide a charcoal briquet product comprised of a number of single-use size charcoal briquet packages which can be easily separated and used by the consumer.

These and other objects of the present invention will become apparent from the following description of the preferred embodiment of the invention, taken together with the accompanying drawings.

BRIEF DESCRIPTION OF THE DRAWINGS

The invention may take physical form in certain parts and arrangements of parts, a preferred embodiment of which will be described in detail and which is illustrated in the accompanying drawings which form a part hereof and wherein.

DESCRIPTION OF THE PREFERRED EMBODIMENT

Figure 1:
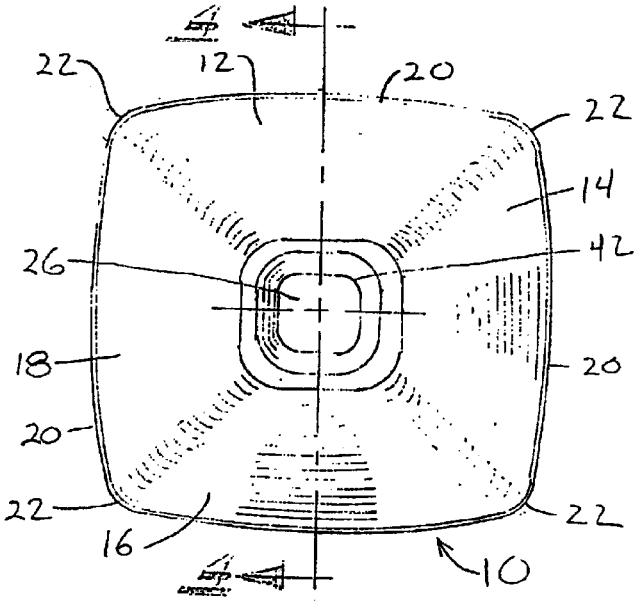
FIG. 1 is a top plan view of a charcoal briquet in accordance with the present invention.

Referring now to the drawings wherein the showings are for the purpose of illustrating a preferred embodiment of the invention only and not for the purpose of limiting same, FIG. 1 shows a charcoal briquet 10 in plan view. Charcoal briquet 10 has a generally square periphery with four sides 12, 14, 16, and 18. Each side has an outer peripheral edge 20 which is gently bowed outwardly towards its center, but relatively straight. The four edges 20 are interconnected by corners 22 with a radius of curvature significantly smaller than the radius of curvature of the gently bowed edges 20. A hole 26 is located in the cental area of the briquet 10 between the sides 12, 14, 16, 18.

Figure 4:
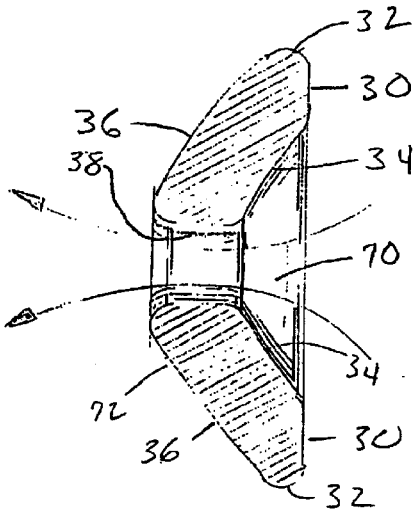
FIG. 4 is a cross-sectional view of the charcoal briquet of FIGS. 1 and 2 taken along line 4—4 of FIG. 1.
Figure 2:
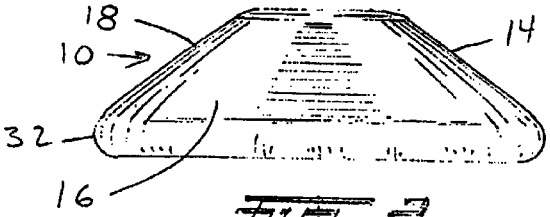
FIG. 2 is a side view of the charcoal briquet of FIG. 1.
Figure 5:
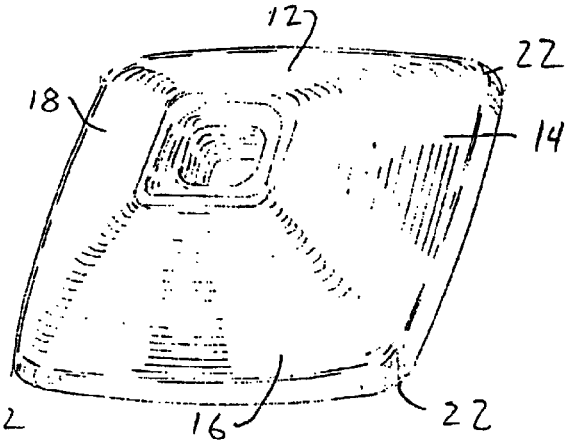
FIG. 5 is a perspective view of the charcoal briquet of FIGS. 1–4.

Referring now to FIG. 4, one sees the charcoal briquet of FIG. 1 in cross section. The charcoal briquet 10 has an upper surface which is generally convex with a hole 26 in the center. The lower surface of the charcoal briquet 10 is generally concave. The briquet back side 12 is bounded by a generally planar horizontal bottom surface 30, a rounded outer peripheral edge 32, an upwardly and inwardly extending lower surface 34, an upwardly and inwardly extending upper surface 36 and a vertically extending inner surface 38 extending between the lower surface 34 and upper surface 36. The lower surface 34 is gently concave but overall extends inwardly and upwardly at an angle of about 30° from the horizontal. The upper surface 36 is gently convex and extends inwardly and upwardly at an angle of about or slightly greater than 30°. The lower surface and upper surface are generally parallel to one another. However, a slight divergence away from one another as one moves towards the center of the briquet may be used.

The front side of the briquet 16 is the mirror image of the back side of the briquet 12. That is, the briquet 10 is symmetrical about its central axis as viewed in the cross section shown in FIG. 4. Moreover, if one rotates the briquet by 90°, one still sees the cross section seen in FIG. 4. That is, the briquet 10 is symmetrical with respect to the side walls 14 and 18, as well as with respect to the side walls 12 and 16, and all the side walls 12, 14, 16, 18 have identical cross sections at their centers and curve identically towards the corners 22.

Figure 3:
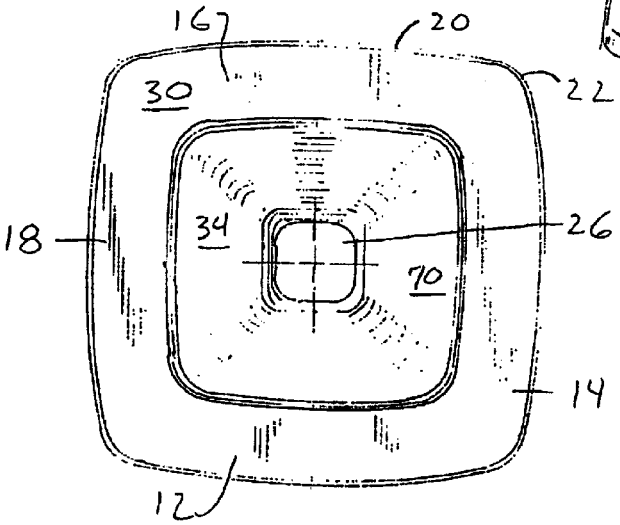
FIG. 3 is a bottom view of the charcoal briquet of FIGS. 1 and 2.

The central portion of the charcoal briquet 10 is occupied by a hole 26 bounded by the vertically extending inner surface 38 of each of the sides 12, 14, 16, 18. As can be seen in FIGS. 1 and 3, the side walls are interconnected by curved hole corners 42. Of course, the hole 26 could have a circular periphery rather than the rounded square periphery illustrated in the figures. Additionally, a briquet having a rectangular outline in the horizontal plane rather than a square outline accomplishes many of the objects of the present invention.

In the preferred embodiment, the briquet is approximately 2.39 inches wide when measured from the center of the outer periphery of one edge to the opposite edge. Thus, the width dimension from the center of the right side 14 to the center of the left side 18 is approximately 2.39 inches. Similarly, the dimension from the center of the front side 16 to the center of the back side 12 is approximately 2.39 inches. The overall height of the briquet from the bottom of the bottom surface 30 to the periphery of the hole 26 is approximately 0.8 inches. The thickness of the sides 12, 14, 16, 18 measured from the inner surface 34 to the outer surface 36 is approximately 0.42 inches. The width of the hole 26 measured diametrically at its narrowest portion is 0.42 inches. This gives an overall volume of the briquet of 2.16 cubic inches, with an approximate weight of 0.056 pound. The surface area of the briquet is about 13.7 square inches. This compares to a standard pillow shaped briquet as is commercially available having a volume of 2.12 cubic inches, an approximate weight of 0.055 pound, a surface area of 8.98 square inches. Thus, the briquet of the present invention having an approximately equal weight is provided with 150% of the surface area of the standard briquet. All of the above figures are approximate, as individual briquets vary considerably.

Figure 6:
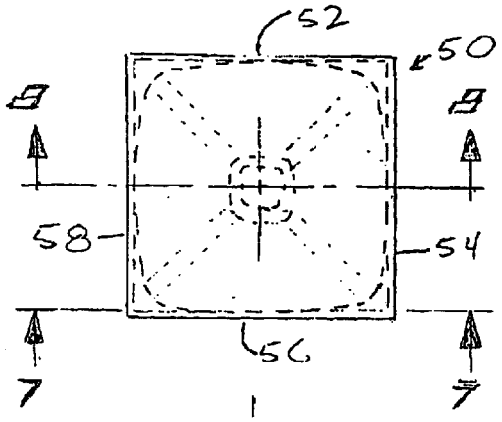
FIG. 6 is a top view of a stack of charcoal briquets within a cardboard retailing container with the top removed.
Figure 7:
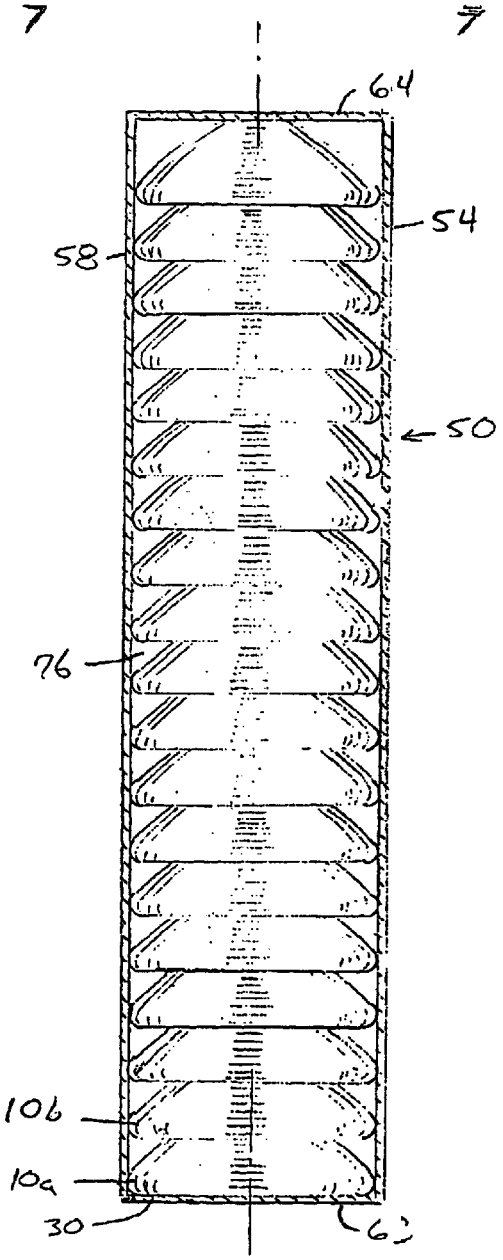
FIG. 7 is a side view of the stack of briquets in the box of FIG. 6 with the closest side wall removed.
Figure 8:
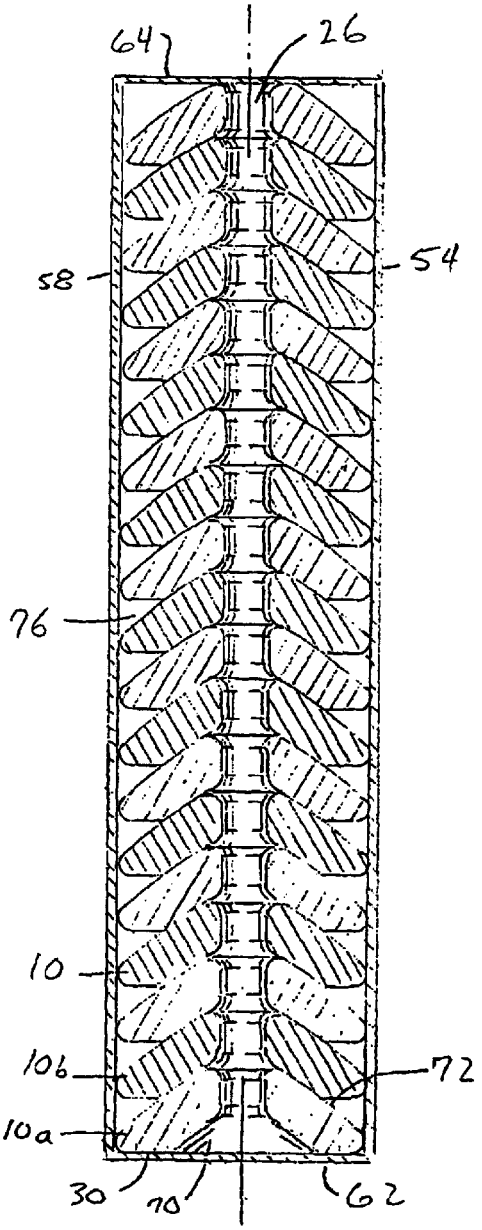
FIG. 8 is a cross section of a stack of briquets in the box seen in FIG. 7 taken along line 8—8 of FIG. 6.

Referring now to FIGS. 6–8, one sees a stack of 19 identical briquets contained within a close fitting cardboard box. The box 50 has a back side 52, a right side 54, a front side 56, and a left side 58. The box is created from a single sheet of cardboard with an extension of the left side 58 being creased and then overlaying a portion of the front side 56 and adhered, as by gluing, to the front side 56. Thus, a sealed square container containing a stack of briquets 10 is illustrated. The box 50 is approximately 2.53 inches wide (outside) in both the right to left and front to back dimensions. This provides inside dimensions snugly accommodating the stack of charcoal briquets 10. Preferably, the box is made from cardboard coated with wax or a similar coating.

As can be seen in FIGS. 7 and 8, extensions are provided on the box side walls 52, 54, 56, 58 forming flaps which are folded and glued or otherwise interconnected forming a box bottom 62 and a box top 64. The flaps connected to the box side walls are conventional and glued together or fastened together in conventional ways.

As can be seen in FIGS. 7 and 8, the bottommost charcoal briquet 10*a* rests upon the bottom 62 of the box 50. The bottom surface 30 of the bottommost briquet 10*a* rests upon the cardboard bottom 62 around its entire periphery. A substantial bearing area is provided between the bottom 30 of the briquet 10*a* and the bottom of the box 62. The second lowest briquet 10*b* rests upon the lower briquet 10*a* with the lower surface 34 of each of the sides 12, 14, 16, 18 of the second briquet 10*b* resting on the upper surface 36 of the sides 12, 14, 16, 18 of the bottom briquet 10*a*. As can thus be seen in FIG. 8, the briquets engage one another over a substantial portion of the upper surface 36 of one briquet and lower surface 34 of the next higher briquet.

The briquets are substantially rectangular or square in outer peripheral shape. The downwardly facing lower surfaces 34 create a somewhat segmented downwardly facing concavity 70 having four separate continuous distinct surfaces on the four sides 12, 14, 16, 18. In the preferred embodiment, the concavity is not a surface of rotation resembling a cone. However, such a shape could be used in implementing the invention. The downwardly facing concavity 70 mates with an upwardly facing convexity 72 formed by the upper surfaces 36 of the four sides 12, 14, 16, 18. The mating of the concavity 70 and the convexity 72 as shown in the stack of FIG. 8 is self-centering. The most compact and stable disposition of the stack is with each of the briquets 10 centered and in full contact with the next lower briquet as illustrated in the figures.

The box 50 containing the single stack of charcoal briquets 10 is a stand alone retail package. Box 50 is printed with appropriate merchandising information, including a universal product code, and is shipped and sold as-is. The box 50 is rectilinear and therefore easily packed into cartons and palletized for handling and distribution. The box 50 is rectilinear and therefore easily stocked onto shelves, into end caps, or center-of-aisle displays at the retailer. The box 50 is sealed and therefore less likely to become contaminated with charcoal dust. The box 50 contains briquets 10 which are stacked in a stable, tight manner minimizing extra air space as well as friction and the creation of charcoal dust. The box 50 is easily purchased by the consumer, as its overall dimensions are approximately 2½×2½ inches by 10⅔. This box weighs approximately one pound and is very easily picked up, placed into a shopping cart, taken home for use, easily stored at home, and easily and cleanly transported in a consumer's vehicle for use at a park or picnic.

In use, the consumer can simply place the box as-is in a grill bed. The wax coated box 50 is ignited and as the box 50 burns, it in turn ignites the periphery 32 of the contained charcoal briquets 10. As can be best seen in FIG. 8, the peripheral portions 32 are spaced from one another when compactly packed, with air gaps 76 provided between the briquet peripheries within the box to promote air flow as the box 50 burns, encouraging ignition of the briquet peripheral edges 32. After the briquets are ignited, the stack is broken up by use of a poker or other appropriate implement. Thereupon, a jumbled random bed of briquets is provided which has a greater surface area per unit mass than conventional briquets. The greater surface area encourages quick combustion to the ready-to-cook state. Moreover, the holes 26 in the centers of the briquets 10 provide an air flow passage causing a vortex action of air passing through the briquets 10, further encouraging combustion to the ready-to-cook temperature.

Figure 9:
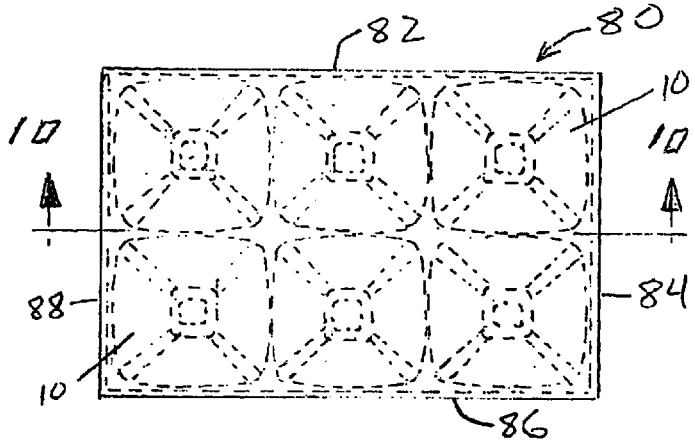
FIG. 9 is a top plan view similar to FIG. 6 showing a larger package of briquets using six adjacent vertical stacks.
Figure 10:
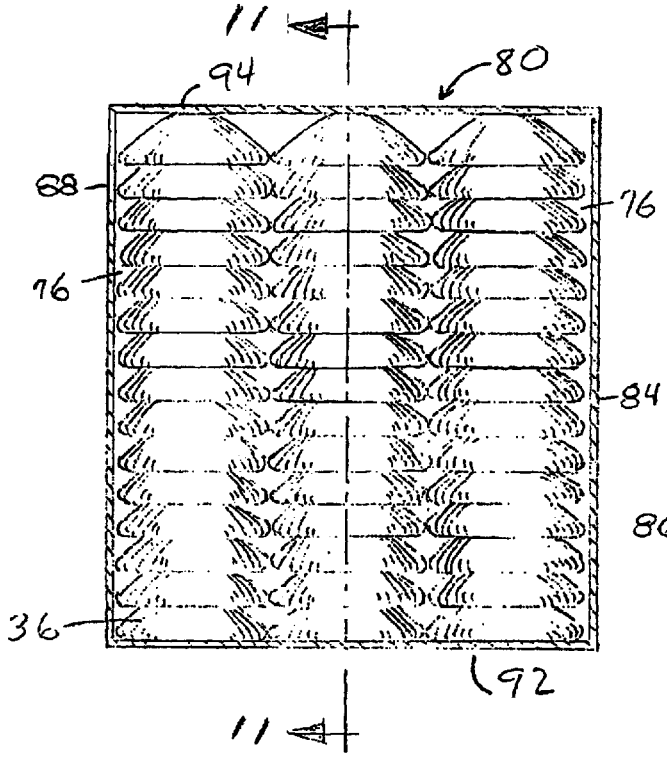
FIG. 10 is a cross section of the package of briquets seen in FIG. 9 taken along line 10—10 in FIG. 9.
Figure 11:
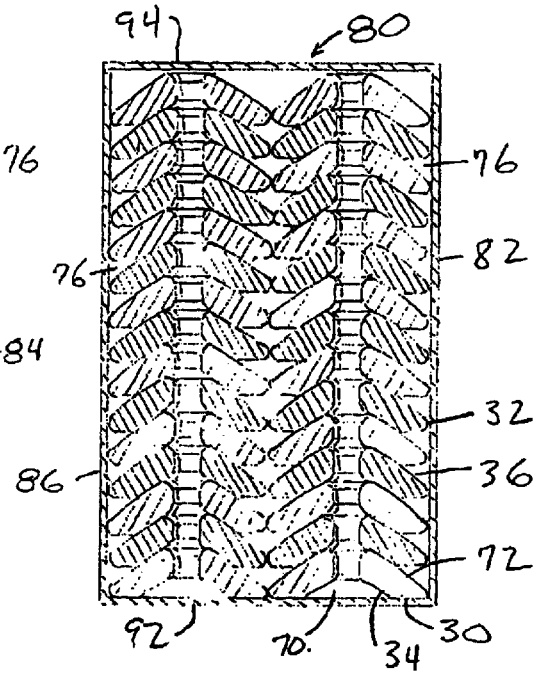
FIG. 11 is a cross section of the package of briquets seen in FIGS. 9 and 10 taken along line 11—11 in FIG. 10.

Referring now to FIGS. 9–11, a different method of packing the briquets 10 of the present invention is disclosed. FIGS. 9–11 illustrate a box of five pounds of identical briquets 10. The five-pound box contains six stacks of briquets disposed in two rows of three. Each of the six stacks comprises an identical number (15) of briquets and the briquets are tightly contained in a rectangular box 80 having four sides 82, 84, 86, 88. The box is constructed from a single sheet of wax-coated paper or cardboard with the sheet of cardboard having a tab extending slightly beyond the end of one of the sides 82 into an overlapping relationship with a second side 88 to which it is adhered. Flaps extend from the sides 82, 84, 86, 88 forming a box bottom 92 and a box top 94. The flaps are engaged as is conventional, forming a completely closed container. This five-pound box 80 of briquets is much more compact, easily handled, and less subject to damage than equivalent bags of briquets. The five-pound boxes are rectilinear, easing stacking and palletization. This greatly eases shipping of the product and prevents damage to the product in shipment. The rectangular boxes are easily stacked onto shelves, displayed as aisle end caps or otherwise displayed at the retailer for purchase by consumers. Moreover, the packages are fabricated from linear cardboard stock, and are therefore easily printed with merchandising information prior to forming into the box. The sealed boxes are relatively easy for consumers to handle, use and store. Optionally, the box is provided with an attached handle by fixing a plastic (or similar material) strap to the top or two opposite sides. The briquets in the box 80 stack in a self-centering manner identical to that seen in the box 50 of FIG. 6. A stable, compact mass of charcoal briquets is thereby provided.

In use, the consumer can either use the entire five-pound box in a manner similar to the one-pound box described above, or open the top of the five-pound box and pour a desired amount of briquets into a pile at the center of a grill. The pile of briquets can then be ignited as conventional. Such a pile of briquets has more favorable ignition characteristics when compared to conventional briquets because of the large surface area-to-mass provided by the briquet shape, and because of the vortex air flow created by the holes 26 in the middles of the briquets in the stack.

Figure 14:
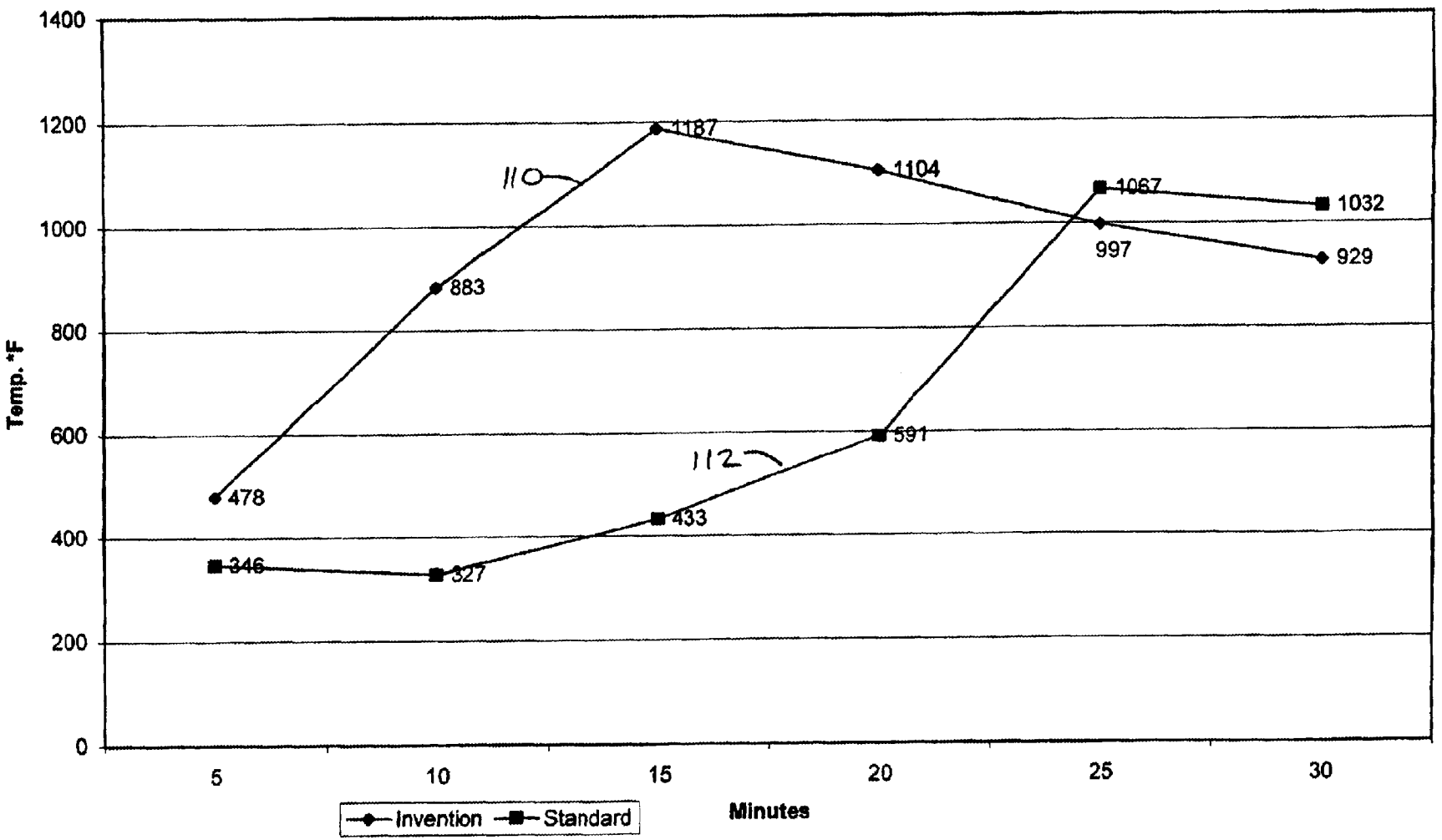

FIG. 14 illustrates the progression from initial ignition (0 minutes) to the ready-to-cook condition of the charcoal briquets of the present invention, as compared to conventional standard charcoal briquets. Line 110 connects data points for the temperature of briquets in accordance with the invention. Line 112 connects data points for standard briquets. It can be seen that the charcoal briquets of the present invention reach a temperature in excess of 1000° approximately 15 minutes after initial ignition, whereas such a temperature is not reached for conventional briquets for approximately 25 minutes. Moreover, the briquets of the present invention hold their ready-to-cook temperature of about 1000° reasonably constantly thereafter. Temperature readings for tests conducted comparing the temperature at 5-minute intervals after initial ignition for the briquets of the present invention when compared to conventional briquets is set forth in Table 1 below.

TABLE 1

| MINUTES | INVENTION | CONVENTIONAL |
|---|---|---|
| 5 | 478 | 346 |
| 10 | 883 | 327 |
| 15 | 1187 | 433 |
| 20 | 1104 | 591 |
| 25 | 997 | 1067 |
| 30 | 929 | 1032 |

As can be seen with reference to the above table and the accompanying FIG. 14, obtaining appropriate cooking temperature is hastened, and maintenance of that temperature is greatly improved.

Figure 12:
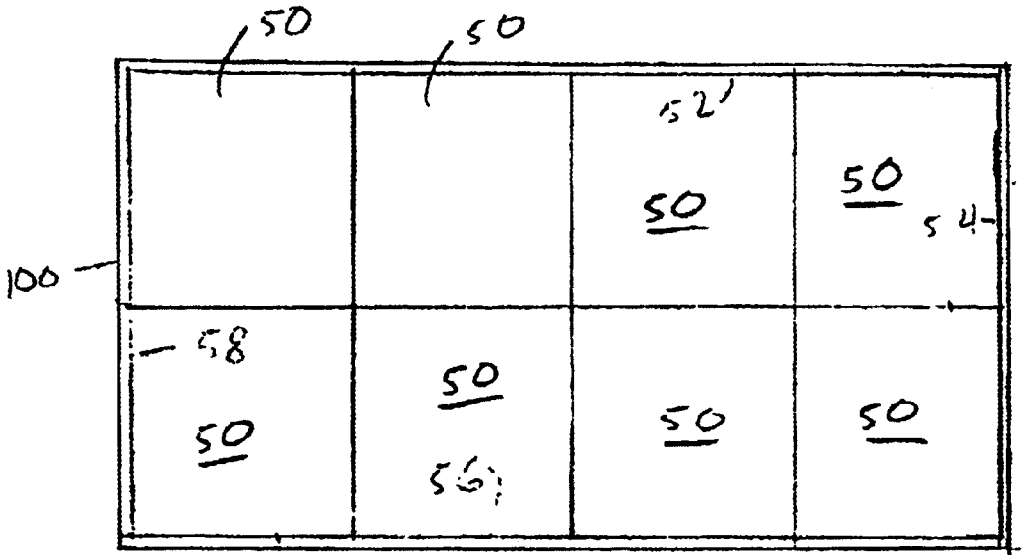
FIG. 12 is a top plan view of several individual use packages of briquets as seen in FIGS. 6–8 combined into a multiple unit product.
Figure 13:
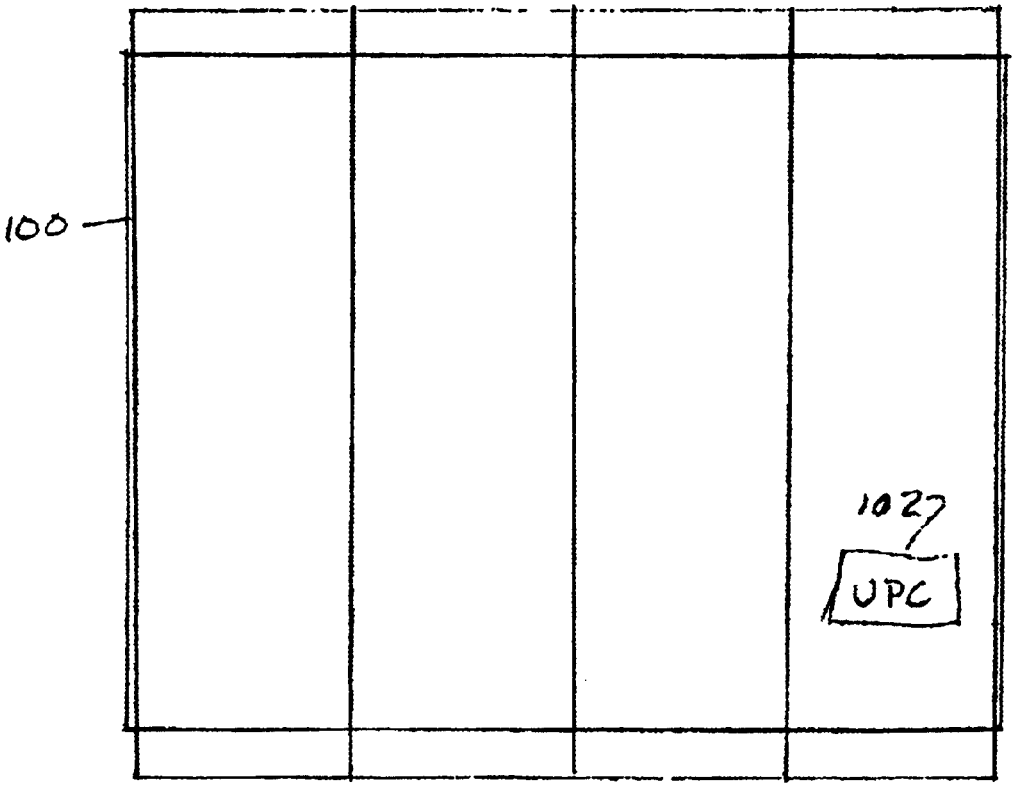
FIG. 13 is a side view of the multiple unit product of FIG. 12; and, FIG. 14 is a graph showing a comparison of combustion temperature versus time for the briquets of the present invention and conventional standard briquets.

An alternative arrangement for packing multiple-pound units of briquets is shown in FIGS. 12 and 13. In FIG. 12, one sees a top view of eight boxes 50 identical in all respects to the package seen in FIGS. 6–8. The eight boxes 50 are held together by an outer wrapper 100 surrounding the sides 52, 54, 56, 58 of the closely-packed boxes 50. The outer wrapper 100 lays closely against boxes 50. The outer wrapper 100 is shown slightly spaced from the boxes 50 in the drawings for purposes of clarity only. The outer wrapper 100 is a wrap, such as a wide plastic wrap, which tightly binds the individual boxes 50 together into a single commercial product bearing its own universal product code 102 and marketing information. The outer wrapper 100 obscures the universal product code of the individual boxes 50 and allows the retailer to sell multiple units as a single package to consumers requiring or desiring more than a single pound of product. The consumer can easily handle the compact package, take it home, and remove separable one-pound boxes as desired. Moreover, the retailer can sell multi-unit packages in outer wrappers 100 or remove the outer wrapper 100 and sell individual one-pound packages 50 bearing their own marketing information. An outer box or similar container can be used in place of the wrapper 100.

The invention has been described with respect to a preferred embodiment. Modifications and alterations of this preferred embodiment will occur to others upon the reading and understanding of the specification. It is our intention to include all such modifications and alterations insofar as they come within the scope of the inventive claims or the equivalents thereof.

Having thus described there invention, it is claimed:

1. A charcoal briquet comprising four side walls of generally identical cross section interconnected to form a rectangle, each said side wall comprising a volume surrounded by a bottom surface, an upwardly and inwardly extending lower surface and an upwardly and inwardly extending upper surface generally parallel to said lower surface, said side wall lower surfaces together forming a downwardly facing concavity and said sidewall upper surfaces together forming an upwardly facing convexity.

2. The charcoal briquet of claim 1, wherein said side walls additionally comprise an inner surface extending from said lower surface to said upper surface, said inner surface surrounding a central hole.

3. The charcoal briquet of claim 2, wherein said lower surface of each said side is generally parallel to the upper surface of said side.

4. The charcoal briquet of claim 3, wherein said lower surfaces and said upper surfaces are generally disposed at an angle of about 30° to horizontal.

5. The charcoal briquet of claim 4, wherein said lower surface of each said side diverges slightly from said upper surface of said side toward said hole.

6. The charcoal briquet of claim 5, wherein said briquet is generally square in shape.

7. The charcoal briquet of claim 6, wherein said briquet has a width and a height and said width is at least twice said height but not more than four times said height.

8. The charcoal briquet of claim 7, wherein said briquet width is approximately three times said height.

9. The charcoal briquet of claim 1, wherein said four side wall lower surfaces together form a downwardly facing concavity and said four side wall upper surfaces together form an upwardly facing convexity, said concavity being adapted to snugly engage the convexity of an identical briquet when stacked.

10. The charcoal briquet of claim 9, wherein said side walls additionally comprise an inner surface extending from said lower surface to said upper surface, said inner surface surrounding a central hole.

11. A charcoal briquet comprising:

a generally convex upper surface;

a generally concave lower surface adapted to engage the upper surface of an identical briquet;

a generally rectangular periphery;

whereby said briquet may be stacked on an identical briquet forming a compact stable stack.

12. A charcoal briquet comprising:

a generally convex upper surface;

a generally concave lower surface adapted to engage the upper surface of an identical briquet;

a generally rectangular periphery;

whereby said briquet may be stacked on an identical briquet forming a compact stable stack; and, said briquet has an overall height and a narrowest width, said narrowest width being at least twice said overall height and not greater than four times said overall height.

13. The charcoal briquet of claim 12, wherein said narrowest width is approximately three times said overall height.

14. A charcoal briquet comprising:

a generally convex upper surface;

a generally concave lower surface adapted to engage the upper surface of an identical briquet;

a generally rectangular periphery;

whereby said briquet may be stacked on an identical briquet forming a compact stable stack; and, said generally concave lower surface comprises four generally planar downwardly and outwardly extending lower side surfaces extending from a briquet central portion to said periphery and said generally convex upper surface comprises four generally planar downwardly and outwardly extending upper side surfaces extending from said briquet central portion to said periphery, said upper side surfaces and said lower side surfaces being generally parallel on each side.

15. The charcoal briquet of claim 14, wherein said central portion contains a hole extending from said concave lower surface to said convex upper surface.

16. The charcoal briquet of claim 14, wherein said lower side surfaces and said upper side surfaces are disposed at an angle of about 30° with respect to horizontal.

17. The charcoal briquet of claim 16, wherein said briquet is generally square.

18. A package of charcoal briquets comprising at least one stack of generally identical charcoal briquets, each charcoal briquet comprising:

a generally convex upper surface;

a generally concave lower surface adapted to engage the upper surface of an identical briquet;

a generally rectangular periphery;

each said briquet except at least one bottom briquet being stacked on another briquet with said concave lower surface resting on the convex upper surface of the next lower briquet;

said at least one stack of charcoal briquets being contained in a cardboard box having four flat side walls, a generally flat bottom wall and a generally flat top wall creating a stackable rectangular box.

19. A package of charcoal briquets comprising at least one stack of generally identical charcoal briquets, each charcoal briquet comprising:

a generally convex upper surface;

a generally concave lower surface adapted to engage the upper surface of an identical briquet;

a generally rectangular periphery;

each said briquet except at least one bottom briquet being stacked on another briquet with said concave lower surface resting on the convex upper surface of the next lower briquet;

said at least one stack of charcoal briquets being contained in a cardboard box having four flat side walls, a generally flat bottom wall and a generally flat top wall creating a stackable rectangular box; and, each said briquet has an overall height and a narrowest width, said narrowest width being at least twice said overall height and not greater than four times said overall height.

20. The package of charcoal briquets of claim 19, wherein said briquet narrowest width is approximately three times said overall height.

21. A package of charcoal briquets comprising at least one stack of generally identical charcoal briquets, each charcoal briquet comprising:

a generally convex upper surface;

a generally concave lower surface adapted to engage the upper surface of an identical briquet;

a generally rectangular periphery;

each said briquet except at least one bottom briquet being stacked on another briquet with said concave lower surface resting on the convex upper surface of the next lower briquet;

said at least one stack of charcoal briquets being contained in a cardboard box having four flat side walls, a generally flat bottom wall and a generally flat top wall creating a stackable rectangular box; and, said generally concave lower surface of each of said briquets comprises four generally planar downwardly and outwardly extending lower side surfaces extending from a briquet central portion to said periphery and said generally convex upper surface of each of said briquets comprises four generally planar downwardly and outwardly extending upper side surfaces extending from said briquet central portion to said periphery, said briquet upper side surfaces and said briquet lower side surfaces being generally parallel on each side.

22. The package of charcoal briquets of claim 21, wherein said briquet central portion contains a hole extending from said concave lower surface to said convex upper surface.

23. The package of charcoal briquets of claim 21, wherein said briquet lower side surfaces and said briquet upper side surfaces are disposed at an angle of about 30° with respect to horizontal.

24. The package of charcoal briquets of claim 23, wherein each said briquet is generally square.

25. A package of charcoal briquets comprising at least one stack of generally identical charcoal briquets, each charcoal briquet comprising:

a generally convex upper surface;

a generally concave lower surface adapted to engage the upper surface of an identical briquet;

a generally rectangular periphery;

each said briquet except at least one bottom briquet being stacked on another briquet with said concave lower surface resting on the convex upper surface of the next lower briquet;

said at least one stack of charcoal briquets being contained in a cardboard box having four flat side walls, a generally flat bottom wall and a generally flat top wall creating a stackable rectangular box; and, each said stack of generally identical charcoal briquets is contained in a single stack cardboard box and several of said cardboard boxes of briquets are bound together to form a commercial product.

26. The package of charcoal briquets of claim 25, wherein said single stack boxes are bound together by an outer wrapper.

27. The package of charcoal briquets of claim 18, wherein said cardboard box is wax coated.

28. The package of charcoal briquets of claim 27, wherein air spaces exist between the peripheries of adjacent briquets in said stack.

29. The package of charcoal briquets of claim 18, wherein said box is adapted to act as an ignition aid for said charcoal briquet.

30. A charcoal briquet comprising:

a generally convex upper surface;

a generally concave lower surface adapted to engage the upper surface of an identical briquet;

a periphery;

whereby said briquet maybe stacked on an identical briquet forming a compact stable stack.

31. A charcoal briquet comprising:

a generally convex upper surface;

a generally concave lower surface adapted to engage the upper surface of an identical briquet;

a periphery;

whereby said briquet may be stacked on an identical briquet forming a compact stable stack; and said briquet has an overall height and a narrowest width, said narrowest width being at least twice said overall height and not greater than four times said overall height.

32. The charcoal briquet of claim 31, wherein said narrowest width is approximately three times said overall height.

33. A charcoal briquet comprising:

a generally convex upper surface;

a generally concave lower surface adapted to engage the upper surface of an identical briquet;

a periphery;

whereby said briquet may be stacked on an identical briquet forming a compact stable stack; and, said generally concave lower surface comprises multiple generally planar downwardly and outwardly extending lower side surfaces extending from a briquet central portion to said periphery and said generally convex upper surface comprises multiple generally planar downwardly and outwardly extending upper side surfaces extending from said briquet central portion to said periphery, said upper side surfaces and said lower side surfaces being generally parallel on each side.

34. The charcoal briquet of claim 33, wherein said central portion contains a hole extending from said concave lower surface to said convex upper surface.

35. The charcoal briquet of claim 33, wherein said lower side surfaces and said upper side surfaces are disposed at an angle of about 30° with respect to horizontal.

36. The charcoal briquet of claim 35, wherein said briquet has four sides and said periphery is generally square.

37. A package of charcoal briquets comprising at least one stack of generally identical charcoal briquets, each charcoal briquet comprising:

a generally convex upper surface;

a generally concave lower surface adapted to engage the upper surface of an identical briquet;

a periphery;

each said briquet except at least one bottom briquet being stacked on another briquet with said concave lower surface resting on the convex upper surface of the next lower briquet;

said at least one stack of charcoal briquets being contained in a cardboard box having at least one side wall, a generally flat bottom wall and a generally flat top wall creating a box.

38. A package of charcoal briquets comprising at least one stack of generally identical charcoal briquets, each charcoal briquet comprising:

a generally convex upper surface;

a generally concave lower surface adapted to engage the upper surface of an identical briquet;

a periphery;

each said briquet except at least one bottom briquet being stacked on another briquet with said concave lower surface resting on the convex upper surface of the next lower briquet;

said at least one stack of charcoal briquets being contained in a cardboard box having at least one side wall, a generally flat bottom wall and a generally flat ton wall creating a box; and, each said briquet has an overall height and a narrowest width, said narrowest width being at least twice said overall height and not greater than four times said overall height.

39. The package of charcoal briquets of claim 38, wherein said briquet narrowest width is approximately three times said overall height.

40. A package of charcoal briquets comprising at least one stack of generally identical charcoal briquets, each charcoal briquet comprising:

a generally convex upper surface;

a generally concave lower surface adapted to engage the upper surface of an identical briquet;

a periphery;

each said briquet except at least one bottom briquet being stacked on another briquet with said concave lower surface resting on the convex upper surface of the next lower briquet;

said at least one stack of charcoal briquets being contained in a cardboard box having at least one side wall, a generally flat bottom wall and a generally flat ton wall creating a box; and, said generally concave lower surface of each of said briquets comprises multiple generally planar downwardly and outwardly extending lower side surfaces extending from a briquet central portion to said periphery and said generally convex upper surface of each of said briquets comprises multiple generally planar downwardly and outwardly extending upper side surfaces extending from said briquet central portion to said periphery, said briquet upper side surfaces and said briquet lower side surfaces being generally parallel on each side.

41. The package of charcoal briquets of claim 40, wherein said briquet central portion contains a hole extending from said concave lower surface to said convex upper surface.

42. The package of charcoal briquets of claim 40, wherein said briquet lower side surfaces and said briquet upper side surfaces are disposed at an angle of about 30° with respect to horizontal.

43. The package of charcoal briquets of claim 42, wherein each said briquet has four sides and said periphery is generally square.

44. A package of charcoal briquets comprising at least one stack of generally identical charcoal briquets, each charcoal briquet comprising:

a generally convex upper surface;

a generally concave lower surface adapted to engage the upper surface of an identical briquet;

a periphery;

each said briquet except at least one bottom briquet being stacked on another briquet with said concave lower surface resting on the convex upper surface of the next lower briquet;

said at least one stack of charcoal briquets being contained in a cardboard box having at least one side wall, a generally flat bottom wall and a generally flat top wall creating a box; and, each said stack of generally identical charcoal briquets is contained in a single stack cardboard box and several of said cardboard boxes of briquets are bound together to form a commercial product.

45. The package of charcoal briquets of claim 44, wherein said single stack boxes are bound together by an outer wrapper.

46. A package of charcoal briquets comprising at least one stack of generally identical charcoal briquets, each charcoal briquet comprising:

a generally convex upper surface;

a generally concave lower surface adapted to engage the upper surface of an identical briquet;

a periphery;

each said briquet except at least one bottom briquet being stacked on another briquet with said concave lower surface resting on the convex upper surface of the next lower briquet;

said at least one stack of charcoal briquets being contained in a cardboard box having at least one side wall, a generally flat bottom wall and a generally flat ton wall creating a box; and, said cardboard box is wax coated.

47. The package of charcoal briquets of claim 46, wherein air spaces exist between the peripheries of adjacent briquets in said stack.

48. A package of charcoal briquets comprising at least one stack of generally identical charcoal briquets, each charcoal briquet comprising: an upper surface; a lower surface adapted to engage the upper surface of a generally identical briquet over a substantial portion of said identical briquet upper surface; and, a briquet periphery; said at least one stack of charcoal briquets being contained in a cardboard box having at least one side wall, a generally flat bottom wall and a generally flat top wall, said at least one side wall engaging at least a portion of said periphery of said briquets.

49. A package of charcoal briquets comprising at least one stack of generally identical charcoal briquets, each charcoal briquet comprising: an upper surface; a lower surface adapted to engage the upper surface of a generally identical briquet over a substantial portion of said identical briquet upper surface; and, a briquets periphery: said at least one stack of charcoal briquets being contained in a cardboard box having at least one side wall, a generally flat bottom wall and a generally flat top wall, said at least one side wall engaging at least a portion of said periphery of said briquets and each said briquet has a surface area and a volume and said surface area in square inches is at least five times said volume in cubic inches.

50. The package of charcoal briquets of claim 49, wherein said surface area in square inches is at least six times said volume in cubic inches.

51. A charcoal briquet having a total surface area measurable in square inches and a total volume measurable in cubic inches, the ratio of said total surface area to said total volume being about 13.7 to about 2.16.

52. The charcoal briquet of claim 51, wherein said briquet has an overall height and a narrowest width, said narrowest width being at least twice said overall height and not greater than four times said overall height.

53. The charcoal briquet of claim 52, wherein said narrowest width is approximately three times said overall height.

54. The charcoal briquet of claim 51, having a generally concave lower surface comprising multiple generally planar downwardly and outwardly extending lower side surfaces extending from a briquet central portion to a periphery and a generally convex upper surface comprising multiple generally planar downwardly and outwardly extending upper side surfaces extending from said briquet central portion to said periphery, said upper side surfaces and said lower side surfaces being generally parallel on each side.

55. The charcoal briquet of claim 54, wherein said central portion contains a hole extending from said concave lower surface to said convex upper surface.

56. The charcoal briquet of claim 54, wherein said lower side surfaces and said upper side surfaces are disposed at an angle of about 30° with respect to horizontal.

57. The charcoal briquet of claim 56, wherein said briquet has four sides and said periphery is generally square.

58. A charcoal briquet having a total surface area measurable in square inches and a weight measurable in pounds, the ratio of said total surface area in square inches to said weight in pounds being about 13.7 to about 0.056.

59. The charcoal briquet of claim 58, wherein said briquet has an overall height and a narrowest width, said narrowest width being at least twice said overall height and not greater than four times said overall height.

60. The charcoal briquet of claim 59, wherein said narrowest width is approximately three times said overall height.

61. The charcoal briquet of claim 58, having a generally concave lower surface comprising multiple generally planar downwardly and outwardly extending lower side surfaces extending from a briquet central portion to a periphery and a generally convex upper surface comprising multiple generally planar downwardly and outwardly extending upper side surfaces extending from said briquet central portion to said periphery, said upper side surfaces and said lower side surfaces being generally parallel on each side.

62. The charcoal briquet of claim 61, wherein said central portion contains a hole extending from said concave lower surface to said convex upper surface.

63. The charcoal briquet of claim 61, wherein said lower side surfaces and said upper side surfaces are disposed at an angle of about 30° with respect to horizontal.

64. The charcoal briquet of claim 63, wherein said briquet has four sides and said periphery is generally square.

65. A selected number of substantially identical charcoal briquets sold as a packaged unit adapted for ignition in a home cooking appliance, said selected number of briquets achieving a cooking temperature of about 1000 degrees about fifteen minutes after ignition and holding said temperature for at least fifteen minutes thereafter.

66. The charcoal briquets of claim 65, each having a generally concave lower surface comprising multiple generally planar downwardly and outwardly extending lower side surfaces extending from a briquet central portion to a periphery and a generally convex upper surface comprising multiple generally planar downwardly and outwardly extending upper side surfaces extending from said briquet central portion to said periphery, said upper side surfaces and said lower side surfaces being generally parallel on each side.

67. The charcoal briquets of claim 66, wherein said central portions contain a hole extending from said concave lower surface to said convex upper surface.

68. The charcoal briquets of claim 66, wherein said lower side surfaces and said upper side surfaces are disposed at an angle of about 30° with respect to horizontal.

69. The charcoal briquets of claim 67, wherein said briquets have four sides and said peripheries are generally square.

70. A packaged charcoal briquet products comprising a selected number of charcoal briquets and a container for said selected number of charcoal briquets having a generally flat bottom and generally flat sides, said briquets being shaped such that adjacent briquets may lie closely adjacent one another covering substantially all said container bottom.

71. The packaged charcoal briquet product of claim 70 wherein each said briquet product of claim 70 wherein each said briquet covering said container bottom is the lowermost in a stack of several vertically aligned charcoal briquets.

72. The packaged charcoal briquet product of claim 71 wherein each charcoal briquet comprises:

a generally convex upper surface;

a generally concave lower surface adapted to engage the upper surface of an identical briquet; and, a periphery.

73. A packaged charcoal briquet products comprising a selected number of charcoal briquets and a container for said selected number of charcoal briquets having a generally flat bottom and generally flat sides, said briquets being shaped such that adjacent briquets may lie closely adjacent one another covering substantially all said container bottom, each said briquet product of claim 70 wherein each said briquet covering said container bottom is the lowermost in a stack of several vertically aligned charcoal briquets, each charcoal briquet comprises:

a generally convex upper surface;

a generally concave lower surface adapted to engage the upper surface of an identical briquets;

a periphery; and, each said briquet has an overall height and a narrowest width, said narrowest width being at least twice said overall height and not greater than four times said overall height.

74. The packaged charcoal briquet product of claim 73, wherein said briquet narrowest width is approximately three times said overall height.

75. A packaged charcoal briquet products comprising a selected number of charcoal briquets and a container for said selected number of charcoal briquets having a generally flat bottom and generally flat sides, said briquets being shaped such that adjacent briquets may lie closely adjacent one another covering substantially all said container bottom, each said briquet product of claim 70 wherein each said briquet covering said container bottom is the lowermost in a stack of several vertically aligned charcoal briquets, each charcoal briquet comprises:

a generally convex upper surface;

a generally concave lower surface adapted to engage the upper surface of an identical briquet;

a periphery; and, said generally concave lower surface of each of said briquets comprises multiple generally planar downwardly and outwardly extending lower side surfaces extending from a briquet central portion to said periphery and said generally convex upper surface of each of said briquets comprises multiple generally planar downwardly and outwardly extending upper side surfaces extending from said briquet central portion to said periphery, said briquet upper side surfaces and said briquet lower side surfaces being generally parallel on each side.

76. The packaged charcoal briquet product of claim 75, wherein said briquet central portion contains a hole extending from said concave lower surface to said convex upper surface.

77. The packaged charcoal briquet product of claim 75, wherein said briquet lower side surfaces and said briquet upper side surfaces are disposed at an angle of about 30° with respect to horizontal.

78. The packaged charcoal briquet product of claim 77, wherein each said briquet has four sides and said periphery is generally square.

* * * * *